US005732763A

United States Patent [19]

Rotharnel et al.

[11] Patent Number: 5,732,763

[45] Date of Patent: Mar. 31, 1998

[54] DEVICE FOR FEEDING MOLTEN METAL PARTICULARLY CAST IRON, TO A CASTING MACHINE, AND CASTING INSTALLATION INCORPORATING SAME

[76] Inventors: Claude Rotharnel, 3 chemin des Cutiers Lotissement de Procheville, F-54700 Pont-a-Mousson, France; Yvon Gallo, deceased, late of Blenod-les-Pont-a-Mousson, France, by Ghislaine Gallo, principle heir

[21] Appl. No.: 553,607

[22] PCT Filed: May 11, 1994

[86] PCT No.: PCT/FR94/00570

§ 371 Date: Apr. 4, 1996

§ 102(e) Date: Apr. 4, 1996

[87] PCT Pub. No.: WO94/26444

PCT Pub. Date: Nov. 24, 1994

[30] Foreign Application Priority Data

May 19, 1993 [FR] France ..... 93 06063

[51] Int. Cl.[6] ..... B22D 11/00

[52] U.S. Cl. ..... 164/421; 164/439; 249/105; 249/109

[58] Field of Search ..... 164/439, 421, 164/338.1, 121; 222/593; 249/105, 106, 109

[56] References Cited

U.S. PATENT DOCUMENTS 4,632,174 12/1986 Pierrel ..... 164/439

FOREIGN PATENT DOCUMENTS 2258919 8/1975 France .
1483517 8/1977 United Kingdom .

*Primary Examiner*—Joseph J. Hail, III
*Assistant Examiner*—I. H. Lin
*Attorney, Agent, or Firm*—Sughrue, Mion, Zinn, Macpeak & Seas, PLLC

[57] ABSTRACT

The molten-metal feed device (1), arranged between a source of molten metal and a casting machine for the ascending continuous casting of cast-iron pipes, has a modular structure (3, 16). This structure includes a syphon (3) for conveying the molten metal from the source of metal to the casting machine, constituting a replaceable component, and plates (16) for heating the syphon (3) which are removably arranged around the latter and in contact with it.

11 Claims, 3 Drawing Sheets

PRIOR ART

DEVICE FOR FEEDING MOLTEN METAL PARTICULARLY CAST IRON, TO A CASTING MACHINE, AND CASTING INSTALLATION INCORPORATING SAME

CROSS-REFERENCE TO RELATED APPLICATION

This application is a 371 of PCT/FR94/00570 filed May 11, 1994.

BACKGROUND OF THE INVENTION

The present invention relates to the casting of molten metals, and more particularly to the vertical continuous casting of metal castings, especially of cast-iron pipes. Although it applies to the casting of various types of metal castings, it is particularly advantageous for the casting of thin cast-iron pipes. The expression "thin pipe" applies to a pipe whose thickness/diameter ratio is low, less than ten per cent, rather than to the thickness considered in isolation by itself.

More specifically, the invention relates to a device for feeding a casting machine with molten metal, especially for an installation for the ascending vertical continuous casting of cast-iron pipes, the said feed device being arranged between a source of molten metal and the casting machine. The source of molten metal is typically a pouring ladle of cast iron and the casting machine a machine for the ascending continuous casting of metal castings, of the vertical-die type. The invention therefore relates to an intermediate link of a casting installation, arranged between the source of molten metal and the device for casting the metal castings as such.

The document FR-A-2,547,517 relating to a vertical continuous casting installation having a die and hot inlet for the casting of metal pipes has already described a liquid cast-iron feed device arranged between a pouring ladle and a vertical die. This feed device includes a syphon unit consisting of a one-piece component made in a refractory material of the alumino-silicate type or made of graphite. This syphon unit includes a vertical duct surmounted by a funnel for receiving the cast iron and a horizontal runner connected up in a sealed manner to the lower end of the die for which it acts as a sole-plate or support.

This syphon unit according to the state of the art raises a certain number of problems. In fact, given the high temperatures involved in the casting of molten metals, the syphon unit is rapidly damaged during the continuous-casting process. In particular, a syphon made of graphite, over and above its relatively high cost, is gradually worn away and/or consumed by the molten cast iron which is in contact with it. Furthermore, a one-piece syphon unit is a relatively bulky component which is difficult to employ, which also complicates the handling necessary when replacing the syphon. The consumption of the graphite may cause modification of the composition of the cast iron, outside the desired analysis.

SUMMARY OF THE INVENTION

The object of the present invention is to remedy the drawbacks exhibited by the known molten-metal feed devices, and in particular by the syphon units as known in the state of the art.

The subject of the invention is consequently a device for feeding a casting machine with molten metal, especially for an installation for the ascending vertical continuous casting of cast-iron pipes, the said feed device being arranged between a source of molten metal and the casting machine, this device being characterized in that it has a modular structure including, on the one hand, a syphon for conveying the molten metal from the source of metal to the casting machine and, on the other hand, removable plates for heating the syphon which are arranged around the latter and in contact with it.

According to other characteristics of the invention:

- the syphon is an interchangeable component, especially made of moulded refractory concrete;
- the syphon is a component having substantially a U shape, including a first substantially vertical channel terminated near the top by an inlet orifice for the molten metal, a second substantially vertical channel emerging at the base of the casting machine via an outlet orifice for the molten metal, and a substantially horizontal channel connecting the vertical channels together;
- around the second channel, the component has a frustoconical shape intended to interact, using a seal, with the matching base of the casting machine;
- the device furthermore includes a shell made of refractory material, surrounding the syphon and the heating plates so as to leave free a space between the inside of the shell and the heating plates, the said space being filled with a thermally insulating and chemically protective material;
- the shell includes means for heating the heating plates, these means especially being constituted by an inductor circuit embedded in the shell, the heating plates acting as armature;
- the thermally insulating and chemically protective material is fine foundry sand;
- the heating plates are made of graphite;
- the stack of the syphon and the heating plates surrounding the syphon is arranged on refractory bricks;
- the syphon includes plane faces for bearing on each heating plate.

The subject of the invention is also an installation for the casting of metal castings, especially one for the ascending vertical continuous casting of cast-iron pipes, characterized in that it includes a molten-metal feed device such as defined above.

A preferred embodiment of the invention will now be described in more detail hereinbelow, referring to the appended drawings, given solely by way of example.

DETAILED DESCRIPTION OF THE PREFERRED EMBODIMENTS

Figure 1:
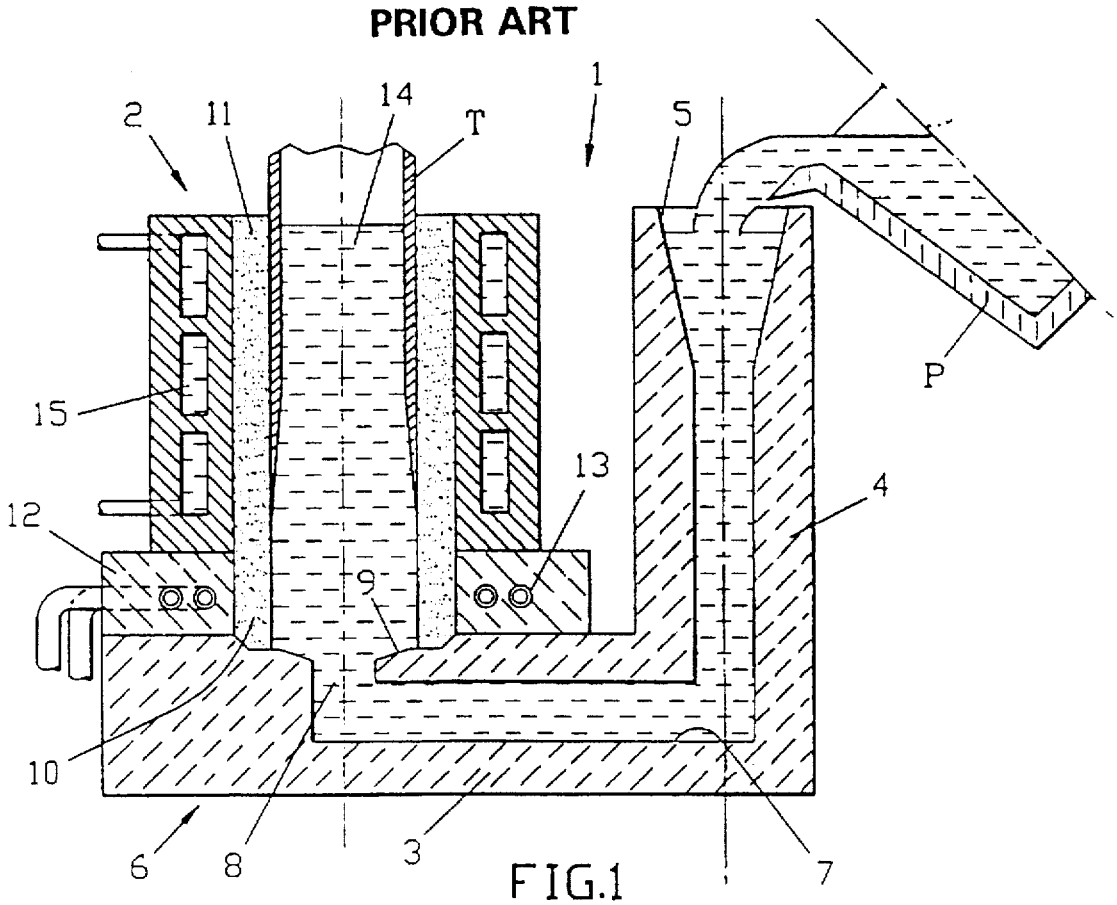
FIG. 1 is a sectional elevation view of a molten-cast-iron feed device according to the state of the art, connected to a die for the continuous casting of cast-iron pipes.

Reference is now made to FIG. 1.

This figure shows a known molten-cast-iron feed device 1 for the feeding of a die 2 intended for the forming of cast-iron pipes T by ascending continuous casting, according to the document FR-A-2,547,517. The actual feed device 1 is composed of a substantially L-shaped syphon unit 3. This syphon unit 3 is essentially made in one piece in a refractory material of the alumino-silicate type or made of graphite. The syphon unit 3 includes a feed duct 4 terminated at its top part by a funnel-shaped flaring 5. The horizontal part 6 of the syphon unit incorporates a horizontal runner 7 emerging on one side into the feed duct 4 and on the other side into an ascending vertical channel portion 8 terminated by a frustoconical flaring 9 emerging into the lower part 10 of the die. The die is essentially composed of a cylindrical graphite tube 11 surrounded at its lower part 10 by a refractory collar 12 in which are embedded the cables 13 of an inductor circuit intended to keep the liquid metal above its melting point. The die 2 is surrounded in its lower part 14 by a cooling circuit 15 which allows gradual solidification of the molten cast-iron for the formation of pipes. During the operation of the feed device 1, a pouring ladle P constitutes the source of molten cast-iron for the feed device 1, which in turn feeds the die 2.

The syphon unit 3 of this feed device 1 is the element which raises the problems which the present invention proposes to solve. In fact, this one-piece unit is not easy to handle and install, and it is expensive, especially when it is made of graphite. In addition, it gradually deteriorates over the course of casting by wear or consumption due to the action of the molten cast-iron. Consequently, in this feed device 1 according to the state of the art, the syphon unit 3 has to be replaced in its entirety when a certain number of pipes have been cast.

Figure 2:
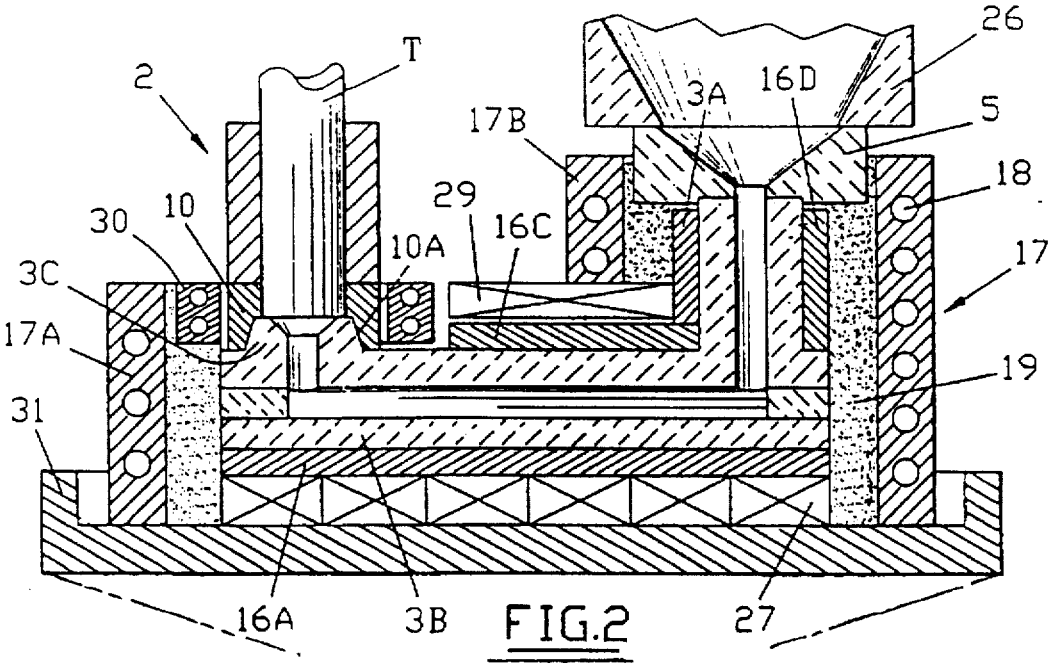
FIG. 2 is a sectional elevation view of the molten-metal feed device according to the invention.

Reference is now made to FIG. 2.

This figure illustrates a molten-metal feed device 1 according to the invention. The invention will be described within the framework of a device for the continuous casting of cast-iron pipes, similar to the device of FIG. 1, feeding a die 2, but simply by way of example.

By its principle, the invention provides a modular feed device, a master component of which is an interchangeable syphon of very low cost. Although the invention may be employed within the framework of casting installations using metals other than cast iron, or with devices for forming castings which are not dies for the formation of pipes, the invention will be described hereinbelow, for reasons of clarity and simplicity, within the framework of an installation for the continuous ascending vertical casting of cast-iron pipes obtained with the aid of a die.

The feed device 1 according to the invention principally includes a syphon 3, means for heating the syphon 3 in the form of heating plates 16 arranged all around the syphon except in the region of its inlet and its outlet, a shell 17 provided with an inductor 18, in which shell are placed the syphon 3 and the heating plates 16, and, finally, an insulating and protective filling material 19 arranged in the space left free between the stack, constituted by this syphon 3 and the heating plate 16, and the shell 17.

Figure 4:
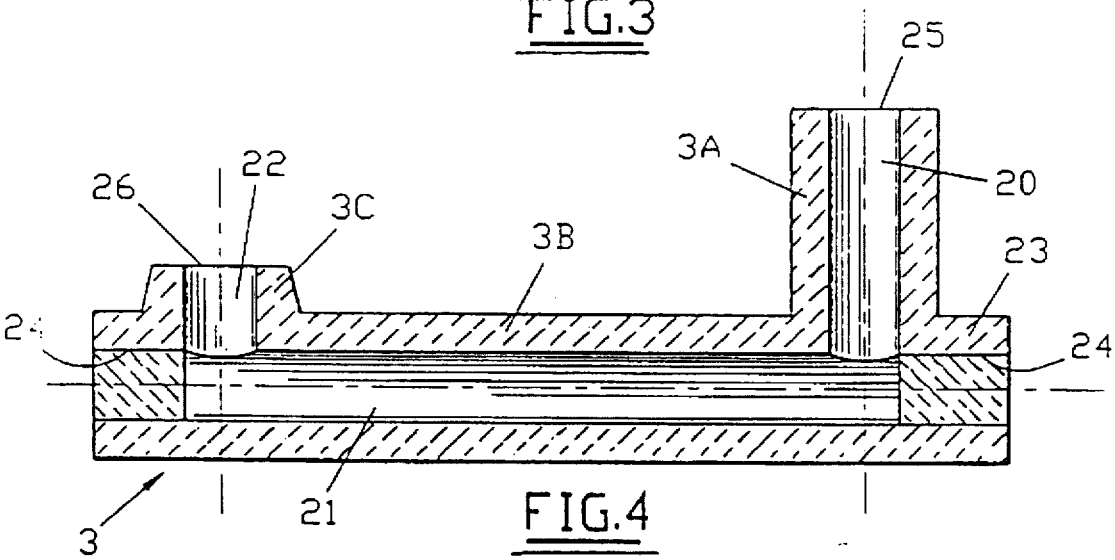
FIG. 4 is a sectional elevation view of a refractory-concrete syphon used in the feed device according to the invention.
Figure 5:
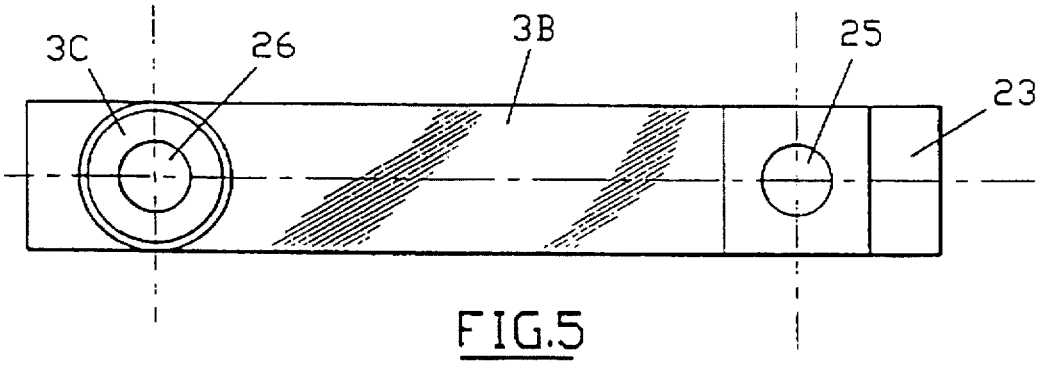
FIG. 5 is a plan view of the syphon of FIG. 4.
Figure 6:
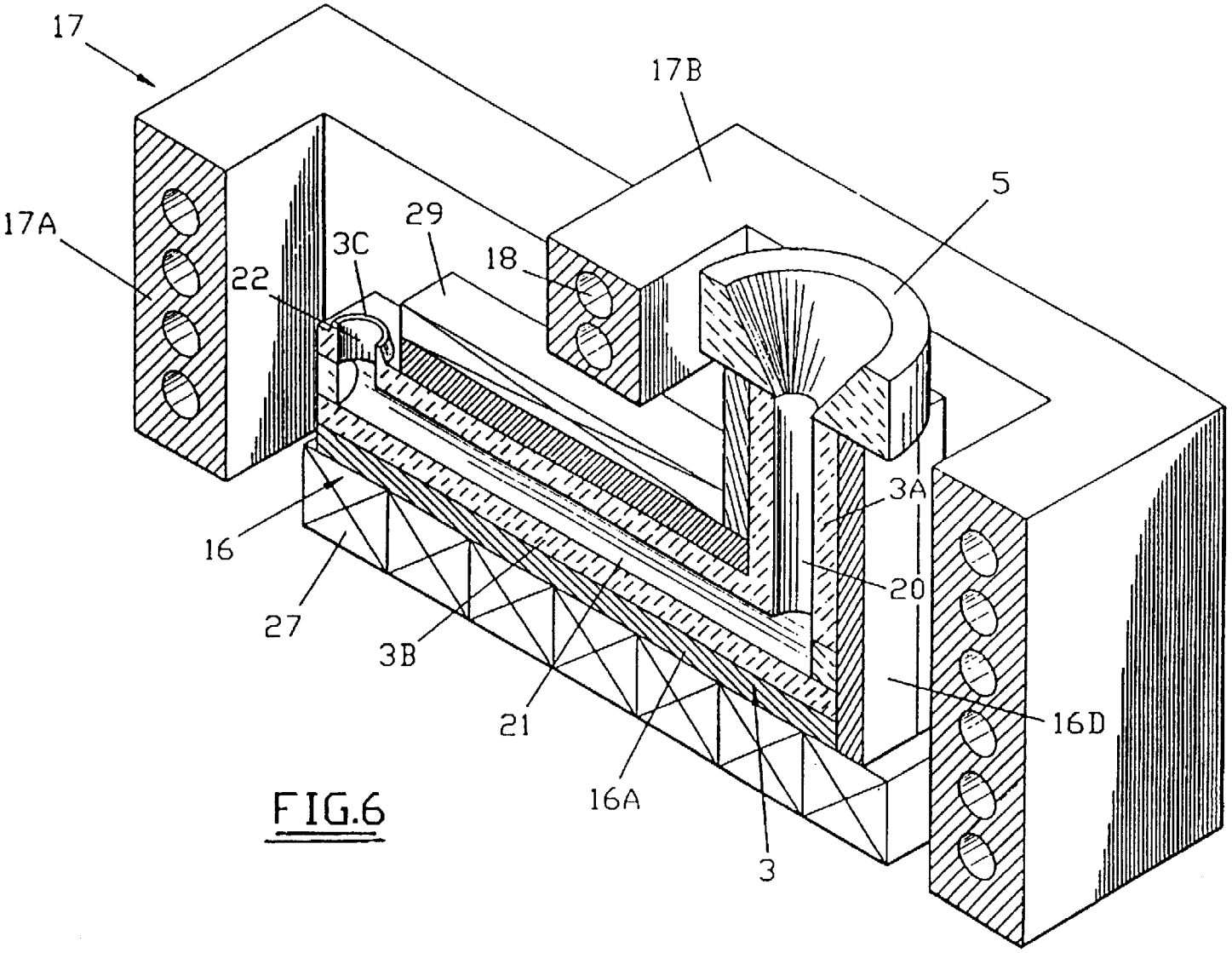
FIG. 6 is a perspective sectional view of the molten-metal feed device according to the invention.

The syphon (FIGS. 4 and 5):

The syphon 3 is shown in more detail in FIGS. 4 and 5. This is a substantially U-shaped component moulded in a low-cost refractory material, especially refractory concrete. The syphon 3 includes a part 3A having a square cross-section provided with a descending vertical inlet channel 20 for the molten cast-iron, a part 3B having a square cross-section provided with a horizontal channel 21 into which emerges a second vertical channel 22 directed upwards, which is much shorter than the channel 20, communicating with the channel 21 and having a frustoconical part 3C; this part 3C ensures the sealed centring of the matching lower part 10A of the heating base 10 of the die (FIG. 2). It should be noted that the part 3B is prolonged slightly beyond the part 3A, thereby defining a horizontal shoulder 23.

Since this syphon 3 is obtained by moulding with cores, the two end holes 24 of the horizontal channel 21 which issue from the moulding are botted with the aid of a manually rammed refractory earth. The syphon 3 consequently includes an inlet orifice 25 and an outlet orifice 26 for the cast iron. When botting up the superfluous holes 24, it will be possible to provide for the insertion of instruments for measuring the temperature of the cast iron inside the syphon, in the form of a thermocouple arranged in an alumina sheath (neither of these being shown), the assembly being inserted into the hole before botting up. The simplicity of this syphon moulded from refractory concrete thereby forms an extremely inexpensive component, of consumable character, intended to be replaced after each casting run.

The funnel (FIG. 2):

Intended to be placed above the inlet orifice 25 of the syphon, this funnel 5 possesses a conical internal shape whose lower part emerges into the vertical channel 20, of the same diameter, for inlet of the liquid cast iron into the syphon. The funnel 5 is also moulded from refractory concrete, preferably identical to that of the syphon. In order to ensure sealing between the funnel 5 and the syphon 3, the funnel is cemented to the syphon with a refractory cement. Like the syphon, the funnel 5 is a consumable and inexpensive component intended to be replaced at the end of one or more casting runs. In order to allow teeming of the cast iron without spilling or splashing, the funnel 5 is surmounted by a funnel-channel 26 made of non-consumable, refractory cement, having a greater opening for receiving the teemed cast iron.

Figure 3:
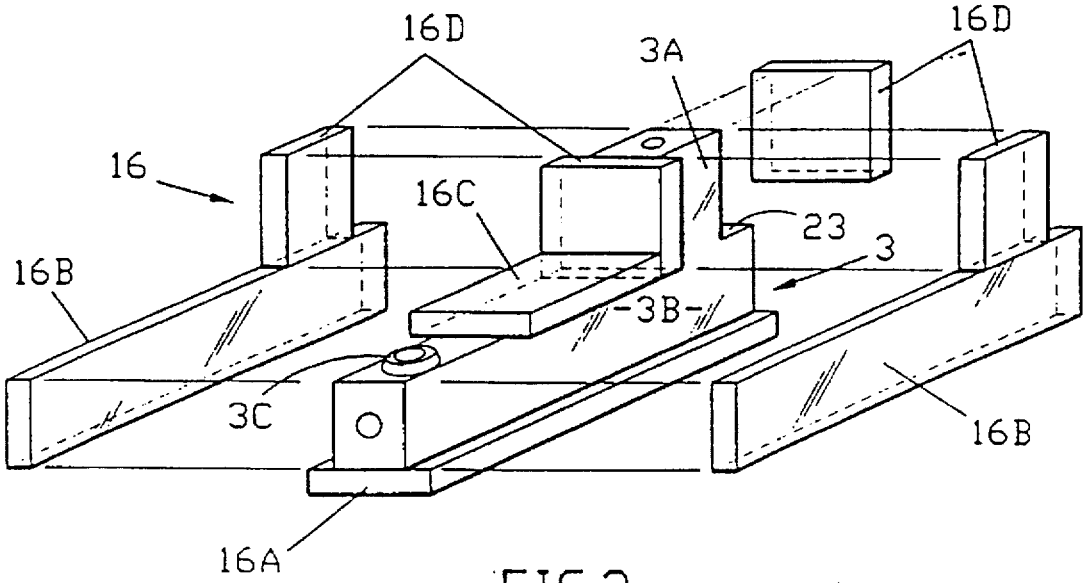
FIG. 3 is an exploded perspective view of graphite susceptors used in the feed device according to the invention.

The heating plates (FIG. 3):

The feed device 1 according to the invention also comprises a set of heating plates 16 intended to keep the liquid cast iron at temperature, by conduction through the material of the syphon. Since these heating plates, also called susceptors, may themselves be heated by induction, the invention provides for plates, for example made of graphite, of a thickness of the order of 30 mm, these being placed directly in contact with the refractory material of the syphon so as to enclose the latter with lower, upper and side plates, as shown in FIG. 3, with the exception of the inlet 25 and outlet 26 orifices of the syphon. Used as a susceptor, the graphite of the plates 16 enables the syphon 3 to be preheated by induction, homogeneously and controllably, up to temperatures of the order of 1000° C.

In the example of FIG. 3, use is made of a baseplate 16A beneath the syphon 3, extending laterally on each side of the part 3B, two vertical side plates 16B adjoined to the part 3B and laid on the edges of the plate 16A, an upper plate 16C laid on the part 3B, and four vertical plates 16D adjoined to the part 3A of the syphon and laid respectively on the plate 16C, on the shoulder 23 on the upper edge of the plates 16B.

Insulating material (FIG. 2):

The stack formed by the graphite susceptor plates 16, the syphon 3 and the funnel 5 is arranged on a line of refractory bricks 27. A shell 17 made of refractory material is arranged around this stack so as to leave free a space 28 between the stack and the shell 17. In a known way, inductor windings 18 are embedded in the thickness of the shell 17 and are fed with electrical current from an external generator, not shown. The shell comprises a principal part 17A which surrounds the part 3B of the syphon and extends above the latter, and a prolongation 17B which surrounds the upper part of the part 3A and extends above the latter.

The space 28 between the shell 17 and the stack constituted by the syphon 3 and the heating plates 16 is filled with a filling material 19 providing the function of thermal insulation and of chemical protection of the heating elements from oxidation. In fact, when the graphite plates 16 are heated to a high temperature due to the effect of the induction phenomena, they have a tendency to be oxidized and to deteriorate. In order to avoid this, the space 28 is preferably filled with fine foundry sand, simply poured between the shell 17 of the inductor and the syphon 3 equipped with the plates 16. The sand flows into the space 28, which it fills perfectly, completely enclosing the graphite heating plates 16 and the syphon 3 for optimum protection of the feed device 1. This sand, which in no way impedes the removal of the shell 17 when dismantling the feed device 1, may be recovered and recycled after each casting run.

As may be seen in FIG. 2, insulating and sand-retaining refractory bricks 29 are arranged on the plate 16C and are inserted beneath the prolongation 17B of the shell 17. In addition, an auxiliary inductor 30 is arranged around the base of the die 2.

The cast-iron feed device 1 according to the invention is used in the following manner. The bricks 27, then the lower heating plate 16A, are laid onto a support which may be a lifting table 31. Onto this lower plate is laid the refractory-concrete syphon 3, then the stacking and positioning of the remaining plates 16 is completed, as shown in FIG. 3. In order to prevent movement between them, the various heating plates are encircled by a retaining means, especially an adhesive tape. Next, the bricks 29 are laid, and the shell 17, which is provided with its inductor means 18 intended for preheating the syphon 3 by means of the heating plates, is brought in, typically with the aid of a gantry crane. This is arranged in a centred way around the syphon 3, then the shell 17 is filled with sand 19 so that all the parts possibly made of graphite are covered. The inductor 30 is then put into place, and the funnel 5 is cemented above the inlet orifice 25 of the syphon 3, and the die 2 is cemented to the part 3C of this syphon, with the aid of refractory cement. Topping up with sand is then carried out, if necessary. Then the preheating inductor 18 is connected to its power supply cabinet (not shown) and the preheating of the feed device 1 is started. Consequently, the heating plates acting as armature, rise in temperature and in turn heat the syphon 3, while remaining insulated thermally and from oxidation by the sand 19 and the bricks 29.

The preheating of the device may take from one to three hours, depending on the power of the inductor circuit. The preparation of the feed device 1 before casting will advantageously be supplemented by blacking the various passageways for the liquid cast iron, so as to prevent solid-cast-iron globules and tongues from sticking during casting.

When the preheating is completed and a pouring ladle P filled with molten cast-iron is available, the conveying of the liquid cast iron to the base of the die by means of the feed device 1 according to the invention may start. The ascending continuous casting of cast-iron pipes will then take place in a conventional way.

At the end of the casting run, the cast iron remaining in the channel 21 of the syphon solidifies. The feed device 1 according to the invention is, dismantled by carrying out, in succession, the removal of the funnel 5 and the funnel-channel 26, the bricks 29, the shell 17, the sand 19, the heating plates 16 and the syphon 3. The latter item will be discarded and replaced by a new syphon. The reconstruction of the feed device 1 according to the invention will then take place, for the next casting run. Consequently, the feed device 1 according to the invention meets the objectives set perfectly. By providing a modular structure comprising an interchangeable syphon of low cost, this device decreases both the cost of production of metal castings and the handling required by the device.

The invention may also be applied to the casting of solid bodies, such as bars.

We claim:

1. Feed device (1) for feeding a casting machine (2) for the ascending vertical continuous casting of cast-iron pipes with molten metal, the said feed device (1) being arranged between a source (P) of molten metal and the casting machine (2), comprising:

a modular structure (3, 16) including a one-piece component syphon (3) for conveying the molten metal from the source (P) of metal to the casting machine (2) and, removable plates (16) for heating said syphon (3), which are arranged around said syphon (3) and in contact with said syphon (3).

2. Feed device (1) according to claim 1, wherein said syphon (3) is an interchangeable component, made of moulded refractory concrete.

3. Feed device (1) according to claim 1, wherein said syphon (3) has substantially a U shape, including a first substantially vertical channel (20) terminated near the top by an inlet orifice (24) for the molten metal, a second substantially vertical channel (22) emerging at the base of the casting machine (2) via an outlet orifice (26) for the molten metal, and a substantially horizontal channel (21) connecting said vertical channels (20, 22) together.

4. Feed device (1) according to claim 3, wherein around said second channel (22), said second channel has a frusto-conical shape (3C) which interacts, using a seal, with a matching base (10A) of the casting machine.

5. Feed device (1) according to claim 1, further comprising:

a shell (17) made of refractory material, surrounding said syphon (3) and said heating plates (16), that leaves a free space (28) between the inside of said shell (17) and said heating plates (16), wherein said free space (28) is filled with a thermally insulating and chemically protective material (19).

6. Feed device (1) according to claim 5, wherein said shell (17) further comprises heating means (18) for heating said heating plates (16), said heating means comprising an inductor circuit (16) embedded in said shell (17), wherein said heating plates (16) act as an armature.

7. Feed device (1) according to claim 5, wherein said thermally insulating and chemically protective material (19) is fine foundry sand.

8. Feed device (1) according to claim 1, wherein said heating plates (16) are made of graphite.

9. Feed device (1) according to claim 1, wherein a stack of said syphon (3) and said heating plates (16) surrounding the syphon (3) is arranged on refractory bricks (27).

10. Feed device (1) according to claim 1, wherein said syphon (3) comprises plane faces for bearing on each said heating plate (16).

11. Installation for the casting of metal castings, for the ascending vertical continuous casting of cast-iron pipes with molten metal, wherein it comprises a molten-metal feed device (1) according to claim 1.

* * * * *